US005636381A

United States Patent [19]

Brogden

[11] Patent Number: 5,636,381

[45] Date of Patent: Jun. 10, 1997

[54] SPORTS GLOVE WITH SPLAYED FINGERS

[76] Inventor: Timothy B. Brogden, 1598 Pope Rd., Creedmoor, N.C. 27522

[21] Appl. No.: 508,869

[22] Filed: Jul. 28, 1995

[51] Int. Cl.[6] ..... A41D 19/00

[52] U.S. Cl. ..... 2/161.1; 2/163

[58] Field of Search ..... 2/161.1, 163, 159, 2/158, 161.6, 160; 273/1.5 A

[56] References Cited

U.S. PATENT DOCUMENTS

| | | | |
|---|---|---|---|
| 458,888 | 9/1891 | Eisele | 2/159 X |
| 703,211 | 6/1902 | Morgan | 2/158 |
| 835,588 | 11/1906 | Wells | 2/159 X |
| 1,284,178 | 11/1918 | Clarke | 2/159 X |
| 1,669,010 | 5/1928 | Natho | 2/159 X |
| 1,746,268 | 2/1930 | Lepetich | 2/159 X |
| 2,884,644 | 5/1959 | Jefferson . | |
| 3,398,951 | 8/1968 | Disko | 2/161.1 X |
| 4,345,335 | 8/1982 | Shih-Li | 2/161.1 X |
| 4,461,043 | 7/1984 | Lomedico | 2/161.1 X |
| 5,367,711 | 11/1994 | Calagui | 2/163 X |

*Primary Examiner*—C. D. Crowder
*Assistant Examiner*—Shirra L. Jenkins
*Attorney, Agent, or Firm*—Olive & Olive, P.A.

[57] ABSTRACT

A sports glove particularly suited for being worn on a player's hand to facilitate ball handling as in basketball handling includes resilient finger positioning members mounted on the glove in positions which tend to splay the fingers of the player's hand.

1 Claim, 3 Drawing Sheets

SPORTS GLOVE WITH SPLAYED FINGERS

BACKGROUND OF THE INVENTION

1. Field of the Invention

This invention relates to sports apparatus and particularly to a sports glove for handling a large ball and particularly a basketball.

2. Description of the Related Art

Numerous sports games, including basketball, football and rugby, use relatively large balls that are hand handled by players so as to out-maneuver an opponent and score points. A player develops proficient ball handling skills in each sport by learning basic ball handling techniques and by constant and continuing practice of these techniques.

Proper hand positioning on the ball, particularly in the game of basketball, is fundamental to good ball handling technique. Proper hand positioning requires, in part, that a player splay his hand(s) to cover the widest surface area of the ball as possible. The more a player maximizes the span of his hand(s), and thus maximizes the surface area of the ball covered by his hand(s), the more control the player is likely to exert over the ball. Improved ball control enables a player to catch the ball more firmly and maintain possession more often when confronted with other players who attempt to seize control. Proper hand positioning also enables a player to pass or shoot the ball without further hand adjustments and thus without hesitation.

In the overall view of sports gloves, it is also helpful to recognize that finger positioning is recognized as being important in the game of golf. In this regard, U.S. Pat. Nos. 2,474,030 and 3,237,950 illustrate sports gloves in which the golfer's fingers are substantially fixedly positioned in what is intended to be a desirable playing position. U.S. Pat. No. 5,295,269 provides useful background and illustrates a sports glove in which the player's fingers are also fixedly positioned.

Proper hand positioning also improves ball throwing accuracy. For example, in basketball if a player properly splays his hand(s) such that the ball easily rolls centrally over the middle three fingers and so as to finally leave through the player's hand in the same manner, the ball has a better chance of reaching its intended target. A ball that passes to either side of the middle fingers, however, is likely to veer away from the ball's intended target.

Players with small hands are at a disadvantage, especially in basketball, because their hands naturally cover less surface area of a ball than the larger hands of typically larger players. Proper hand positioning is essential for a player with small hands to successfully compete against larger players.

Traditionally, proper hand position is taught by verbal and visual teaching, most often by a coach, and is perfected by continuous practice. However, up to this point, there has been no device that a player can wear that assists players to maximize the span of their hand and thus improve their hand positioning and ball handling skills.

It is therefore an object of this invention to provide a glove that is worn on a ball player's hand to bias the fingers to a splayed position, so as to improve hand positioning and thus ball handling skills.

SUMMARY OF THE INVENTION

The sports glove of the invention is formed as a glove with outwardly extending independently moveable, open-ended tubular inserts for partly covering the thumb and fingers of a player's hand which is used for handling and shooting the ball. Resilient, wedge-shaped pieces of foam, rubber or similar material such as used for padding are secured between the finger inserts and when the glove is worn, act to force the player's fingers apart so as to compel the player to adopt a favorable ball handling posture for the hand covered by the glove.

DETAILED DESCRIPTION OF THE INVENTION AND PREFERRED EMBODIMENTS THEREOF

Figure 1:
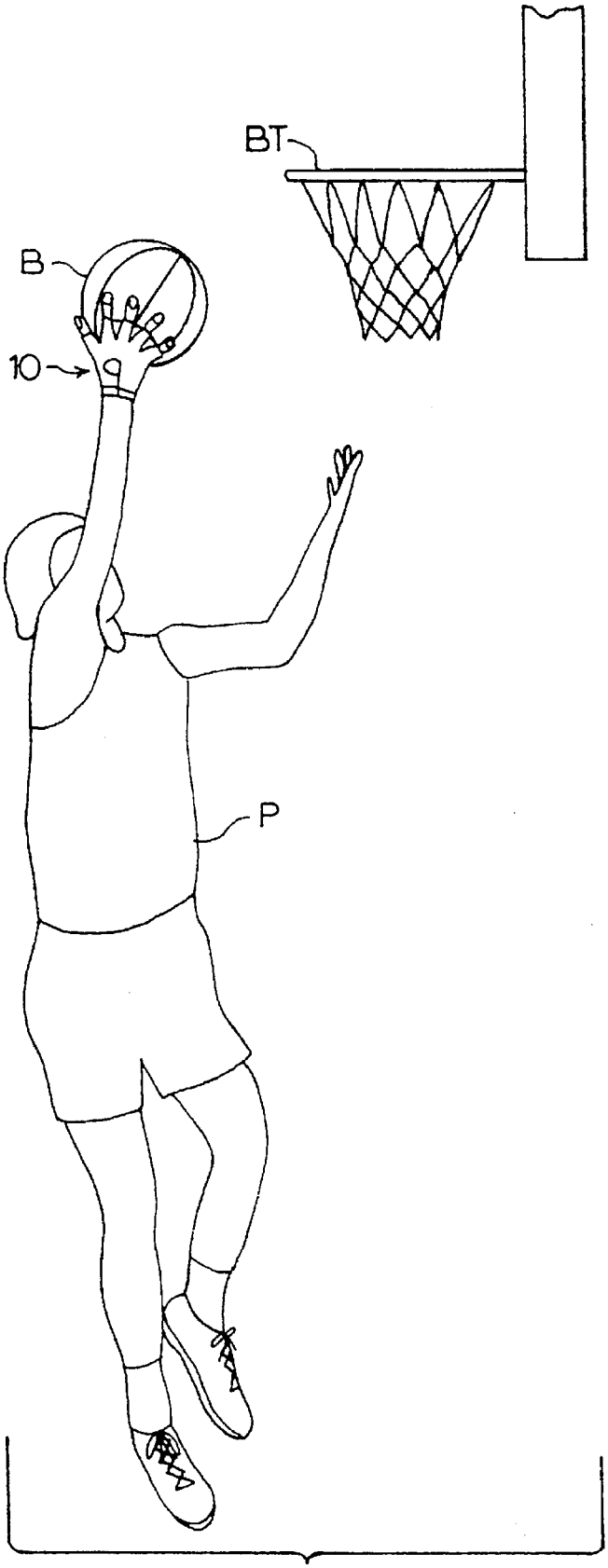
FIG. 1 illustrates how a basketball player typically wears and uses the sports glove of the invention.

FIG. 1 shows a basketball player P wearing the sports glove 10 of the invention on the player's right hand and illustrating the player P about to shoot the ball B into the basket BT. The sports glove 10 can of course be worn either during practice as intended to be illustrated in FIG. 1, in an actual game or in a warm-up prior to actual practice or play to stretch the hand muscles and to induce or prompt the player to maximize hand span during an ensuing practice or game. Sports glove 10 can also be tailored for use as either a right-hand or left-hand glove.

Figure 2:
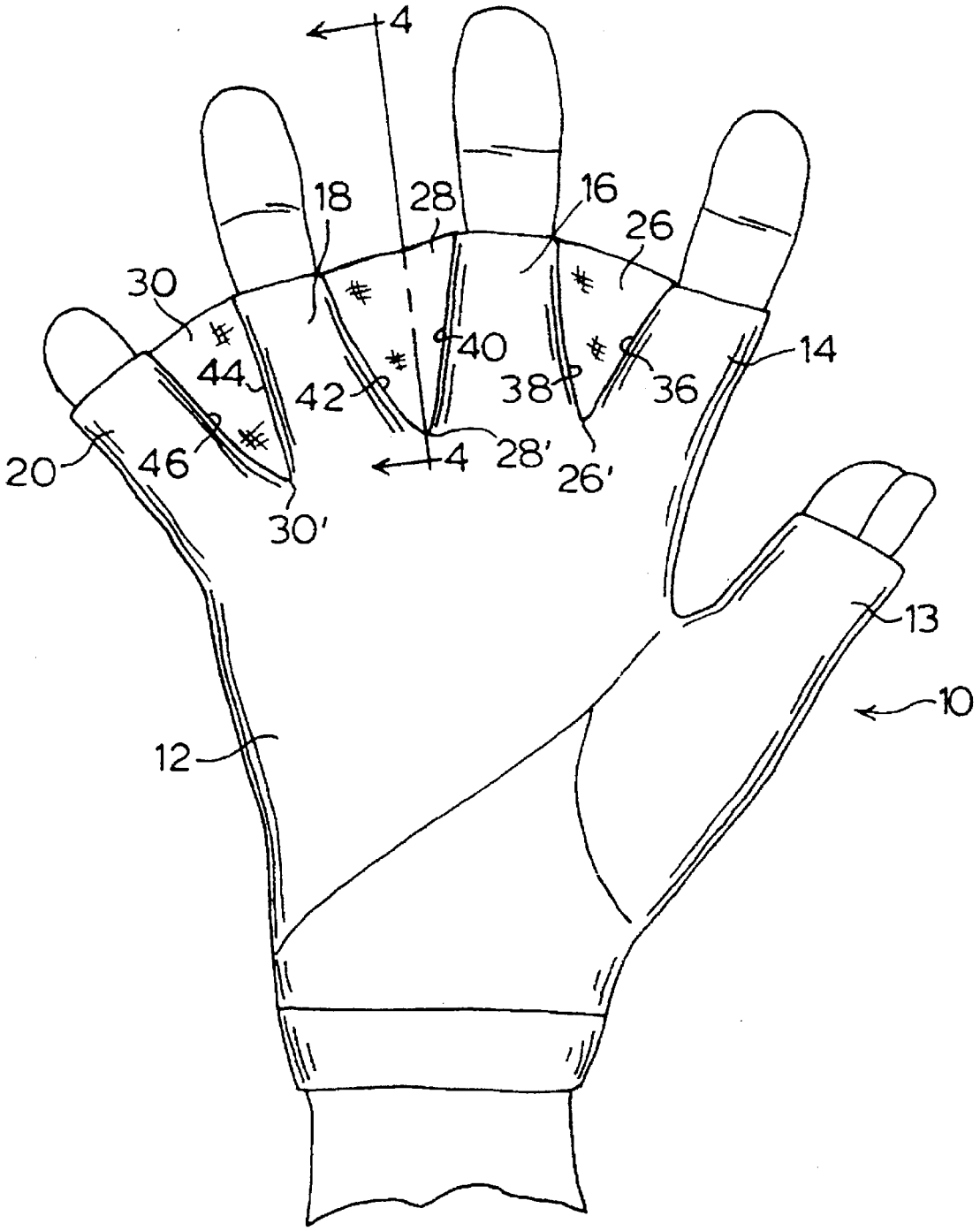
FIG. 2 is a bottom view of the sports glove of the invention as it appears when worn on a player's hand.
Figure 3:
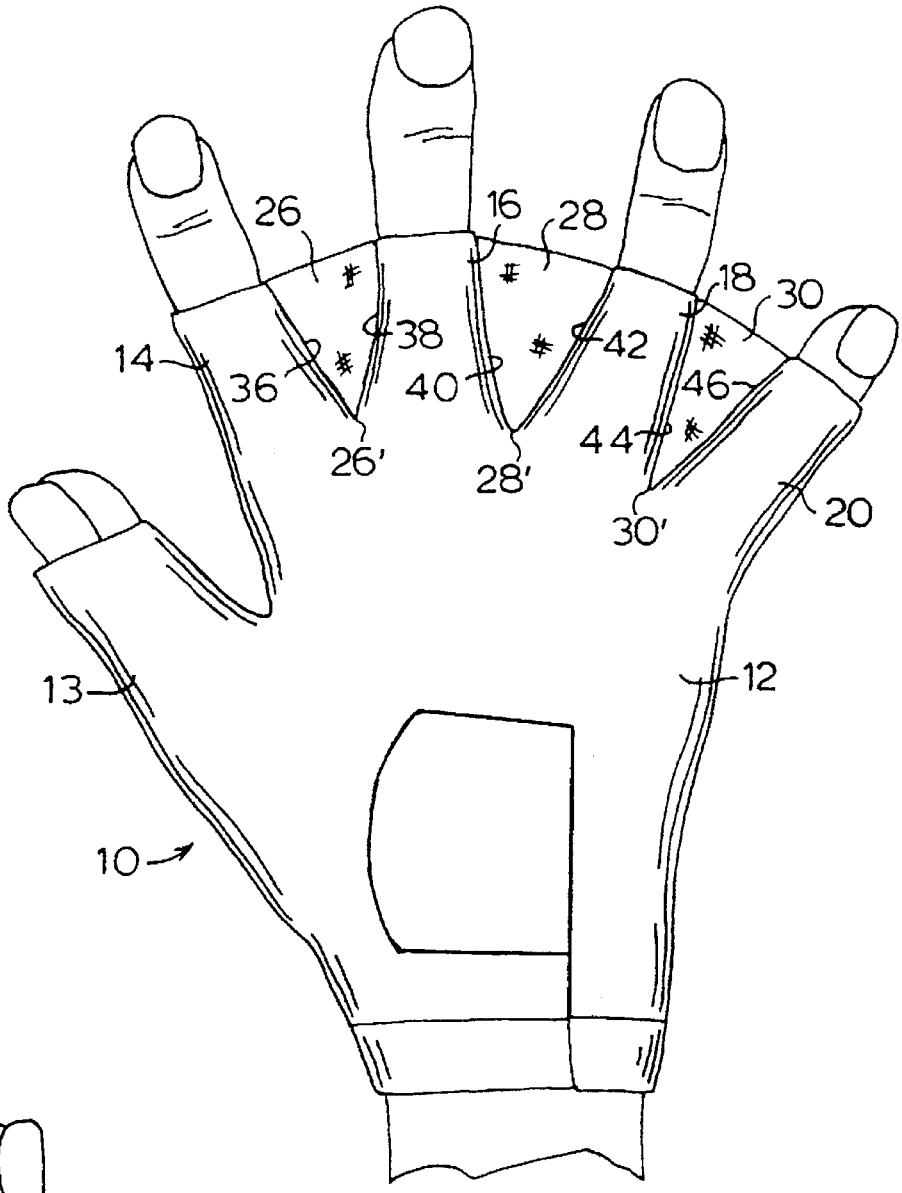
FIG. 3 is a top view of the sports glove of the invention illustrated being worn on a player's hand as in FIG. 2.

Sports glove 10 includes an inner glove portion 12 which receives and covers the palm and back of the hand of the player wearing the glove and generally extends from adjacent the wearer's wrist to the base of the wearer's thumb and fingers as shown in FIGS. 2 and 3. The sports glove 10 also includes a tubular, open-ended, thumb portion 13, and first, second, third, and fourth tubular, open-ended, finger portions 14, 16, 18, and 20 respectively, each of which is adapted to receive a respective player's thumb or finger of one hand are formed so as to be integral with and extending outwardly from the inner glove portion 12 at the base of the respective thumb and finger portions and to be independently moveable. The tubular thumb portion 13, and the tubular finger portions 14, 16, 18, each preferably extend from the base of the respective player's fingers and thumb to the first joint of each. The tubular finger portion 20 extends from the base of the player's finger to the second joint. The first and second finger portions 14, 16 have respective inwardly facing side surfaces 36, 38. The second and third finger portions 16, 18 have respective inwardly facing side surfaces 40, 42. The third and fourth finger portions 18, 20 have respective inwardly facing side surfaces 44, 46. Each pair of inwardly facing side surfaces 36, 38, 40, 42 and 44 and 46 of each respective adjacent finger portion form a V shape when the finger portions are in a splayed position. While desirable to have both the inner glove portion 12 and finger portions 14, 16, 18 and 20 formed as an integral structure, it is recognized that the inner glove portion 12 could be eliminated and other means employed to mount the finger portions.

Any suitable type of fabric, leather, simulated leather or the like such as used in golf gloves, bowling gloves and the like may be employed. Size adjusting straps, though not shown, may be employed.

An important aspect of the present invention is the presence of the three resilient wedge-shaped, finger positioning, members 26, 28 and 30 located in between and preferably permanently attached to respective inwardly facing side surfaces, 36 and 38, 40 and 42, 44 and 46. The respective apex 26', 28' and 30' of each member 26, 28, 30 is located at the base of the V formed by the respective inwardly facing surfaces 36 and 38, 40 and 42, 44 and 46. Members 26, 28 and 30 act to separate and bias the player's fingers to an optimum splayed position. Finger separating members 26, 28 and 30 are made from a suitable resilient foam, rubber or like material such as used for padding and in one embodiment were made of a foam material and were approximately one inch thick from front to back. While preferably permanently attached, it is recognized that members 26, 28, 30 could be made in a detachable form by use of snap features, Velcro hook and nap fasteners or the like. It is also contemplated that members 26, 28, 30 could comprise inflatable chambers mounted, located and shaped so as to splay the fingers in the manner described.

Figure 4:
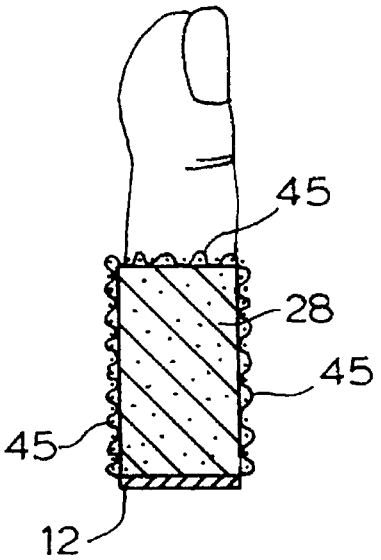
FIG. 4 is a section view of the sports glove of the invention taken along line 4—4 of FIG. 2.

The exposed surfaces of members 26, 28 and 30 are preferably protected and enclosed between the respective finger portions 14, 16, 18, and 20 by a flexible, net-like covering 45 (FIG. 4). Covering 45 is attached to the outer edge on both sides of each inwardly facing surface 36, 38, 40, 42, 44, 46. Covering 45 can be made from the same material as the glove itself but is preferably made from a relatively thin, stretchable and flexible net-like material.

In use as best seen in FIG. 1, the player dons the glove 10 of the invention on the hand which is to be used for handling the ball. The player's fingers are inserted in the corresponding tubular finger portions 14, 16, 18 and 20 and any size adjusting strap (not shown) secured. The player then permits the resilient wedge-shaped members 26, 28 and 30 to splay the fingers and thereby assume an optimum position for handling the ball.

It is recognized that while not illustrated, those skilled in the art will appreciate that the wedge-shaped members 26, 28 and 30 to splay a player's fingers are capable of being mounted between the wearer's fingers in a number of ways other than in the manner which has been illustrated and described. By way of a first example, the sports glove can comprise wedge shaped members and finger portions made from a single resilient molded material that is slipped over the lower portions of the wearers fingers. The resilient material would fit firmly to the wearer's fingers. A second example comprises a resilient stretchable strap having, for example, interrelating Velcro hook and nap pieces attached to each end and wedge shaped members attached intermittently along the straps inner surface. The strap's inner surface is firmly wrapped around the lower portion of a wearer's fingers and the Velcro hook and nap pieces are fastened together such that the wedge shaped members are positioned between the wearers fingers. The strap can be easily loosened or tightened to better fit around an individual player's fingers. A third example, comprises independent wedge-shaped members that are temporarily and directly adhered between and to a player's fingers, and then disposed of after use.

White the invention has thus been described with reference to specific embodiments thereof, it will be appreciated that numerous variations, modifications, and embodiments are possible, and accordingly, all such variations, modifications, and embodiments are to be regarded as being within the spirit and scope of the invention.

I claim:

1. A hand mountable device for handling a relatively large size ball in a sport, comprising:

(a) a thumb, first, second, third, and fourth open ended, tubular, independently moveable finger portions covering respective portions of a wearer's fingers located proximate the wearer's palm which normally engage a ball of a size substantially larger than the hand of the wearer, said thumb finger portion covering the thumb of the wearer and being free of attachment to the remaining finger portions, said first, second, and third finger portions covering fingers between the thumb and little finger of the wearer, said fourth finger portion covering the little finger of the wearer, said first, second, and third finger portions extending substantially from the base of the respective wearer's fingers outwardly to the first joint of each and said fourth finger portion extending substantially from the base of the wearer's little finger outwardly to its second joint;

(b) finger positioning members formed of resilient material, individual ones of said finger positioning members being shaped to accommodate the space between and secured to and located respectively between said first and second, said second and third and said third and fourth finger portions;

(c) an inner glove portion joined to each of said finger portions and operative to mount said finger portions and finger positioning members on the hand of the wearer of said device; and (d) wherein the shape, location and resilience of said finger positioning members serve to continually bias those of the wearer's fingers covered by said first, second, third, and fourth finger portions to a splayed position for maximizing the wearer's span while permitting the respective first joint to finger tip portion of the wearer's fingers covered by said first, second, and third portions to touch the ball being handled so as to enhance the wearer's ability to handle the ball.

* * * * *